US011161673B2

(12) United States Patent
Wines et al.

(10) Patent No.: US 11,161,673 B2
(45) Date of Patent: Nov. 2, 2021

(54) SYSTEM AND METHOD FOR THE STORAGE AND PROTECTION OF PRICELESS WORKS OF ART

(71) Applicants: James L. Wines, Brooklyn, NY (US); Dennis Fisher, Brooklyn, NY (US)

(72) Inventors: James L. Wines, Brooklyn, NY (US); Dennis Fisher, Brooklyn, NY (US)

( * ) Notice: Subject to any disclaimer, the term of this patent is extended or adjusted under 35 U.S.C. 154(b) by 0 days.

(21) Appl. No.: 16/165,971

(22) Filed: Oct. 19, 2018

(65) Prior Publication Data

US 2020/0002076 A1 Jan. 2, 2020

Related U.S. Application Data

(60) Provisional application No. 62/691,943, filed on Jun. 29, 2018.

(51) Int. Cl.

| | |
|---|---|
| ***B65D 81/02*** | (2006.01) |
| ***B65D 81/26*** | (2006.01) |
| *A47F 3/00* | (2006.01) |

(52) U.S. Cl.

CPC ..... *B65D 81/266* (2013.01); *A47F 3/001* (2013.01); *A47F 3/005* (2013.01); *B65D 81/02* (2013.01)

(58) Field of Classification Search

CPC . A47F 3/001; A47F 3/005; B44D 7/00; A47B 47/047; A47B 47/0025; A47B 47/0066; A47B 47/0075; A47B 47/0091; A47B 47/0042; B65D 81/266; B65D 81/02; B65D 81/24; B65D 7/16; B65D 21/08; B65D 21/083; B65D 85/30; B65D 21/0201; B65D 21/086; B65D 81/05

USPC ..... 312/114, 107, 108, 111, 257.1, 263, 312/265.5, 365.6, 31, 348.3; 206/449, 206/454, 575; 220/494, 4.28, 4.33

See application file for complete search history.

(56) References Cited

U.S. PATENT DOCUMENTS

| | | | | |
|---|---|---|---|---|
| 3,117,688 A * | 1/1964 | Walstad | B65D 25/06 217/7 |
| 3,687,512 A * | 8/1972 | Alston | F16B 12/24 312/348.2 |
| 4,002,261 A * | 1/1977 | Litchfield | F16B 12/02 220/683 |
| 4,156,498 A | 5/1979 | Miller | |
| 4,226,488 A * | 10/1980 | Vincent | A47B 67/04 312/108 |
| 4,664,254 A | 5/1987 | Sitwell et al. | |

(Continued)

FOREIGN PATENT DOCUMENTS

| | | |
|---|---|---|
| DE | 9317285 | * 2/1994 |
| DE | 202020102755 | * 5/2020 |

OTHER PUBLICATIONS

CN205499854 Cai et al; abstract and figure (Year: 2016).*

(Continued)

*Primary Examiner* — Janet M Wilkens

(74) *Attorney, Agent, or Firm* — Douglas Wyatt

(57) ABSTRACT

A reusable preservation and storage frame system is provided having a interlocking frame wall system of a non-off-gassing nature, such as aluminum, and includes a back panel and front lid, which provides for utilization of channels for connector systems, and internal support systems for a stackable storage frame, adaptable for storage of artwork of various dimensions.

17 Claims, 6 Drawing Sheets

(56) References Cited

U.S. PATENT DOCUMENTS 5,203,135 A * 4/1993 Bastian ..... F16B 7/0413 403/292
5,207,343 A 5/1993 Bogadi
5,259,523 A 11/1993 Scherb
5,269,600 A * 12/1993 Arreola ..... A47B 88/975 312/348.3
5,348,383 A * 9/1994 Ritt ..... A47F 3/005 312/138.1
5,466,058 A * 11/1995 Chan ..... A47B 47/0075 312/111
5,724,886 A * 3/1998 Ewald ..... A47F 10/06 99/374
5,803,258 A * 9/1998 Gonzalez-Rivera ... B65D 85/30 206/454
5,813,738 A * 9/1998 Cheng ..... F16B 12/14 312/257.1
5,888,114 A 3/1999 Slocum et al.
6,615,841 B2 * 9/2003 DeLoach ..... A24F 25/02 131/290
6,974,041 B2 * 12/2005 Salemi ..... A47B 65/10 211/43
7,051,878 B2 * 5/2006 Randhawa ..... B65D 25/102 206/521
7,686,169 B1 * 3/2010 Harte ..... B65D 81/113 206/583
8,397,937 B2 * 3/2013 Preschke ..... A47B 88/994 220/529
9,380,807 B2 * 7/2016 Busby ..... A47F 7/0035
2004/0074788 A1 4/2004 Blinkhorn et al.
2008/0121558 A1 * 5/2008 Roy ..... B65D 85/48 206/586
2011/0252984 A1 * 10/2011 Chung ..... H05K 1/141 99/483
2014/0053443 A1 2/2014 Prayias
2014/0224795 A1 8/2014 Parnall
2015/0209530 A1 * 7/2015 White ..... A61M 11/042 424/729
2019/0322445 A1 * 10/2019 Farrar ..... B65D 81/05

OTHER PUBLICATIONS

Lee W. Young, Written Opinion of the International Searching Authority, Notification of Transmittal of the International Search Report and the Written Opinion of the International Searching Authority, or the Declaration, dated May 31, 2019, International Application No. PCT/US 19/00010.

Harry C. Kim, International Preliminary Report on Patentability (Chapter II of the Patent Cooperation Treaty), dated Jan. 30, 2020, International Application No. PCT/US2019/000010.

Masahiko Tsukada, et al, "A New Strategy for Assessing Off-Gassing From Museum Materials: Air Sampling in Oddy Test Vessels," American Institute for Conservation of Historic and Artistic Works, Jan. 2012, p. 1-7, vol. 37, No. 1.

* cited by examiner

SYSTEM AND METHOD FOR THE STORAGE AND PROTECTION OF PRICELESS WORKS OF ART

PRIORITY

This application claims priority of U.S. Provisional Application Ser. No. 62/691,943, having a filing date of Jun. 29, 2018, the entire contents of which are all relied upon and fully incorporated herein by reference.

FIELD OF THE INVENTION

The field of invention relates to preservation systems and methods for valuable and priceless works of art.

BACKGROUND OF THE INVENTION

Valuable and priceless works of art naturally degrade over time based on their composition, such as fading of inks, pigments or dyes used on fabric, wood or paper works such as paintings and reliefs. In addition, environmental factors that the work of art is exposed to, such as air, moisture, and sunlight also have an effect on the longevity of an artwork over time, such as also may degrade sculptures.

A traditional wooden storage frame (sometimes called a "travel frame") is a frame constructed out of wood, usually pine or poplar, that is used to store or transport fragile artworks. It can have a lid constructed out of wood and Coroplast™, wooden front slats, or no lid at all. The traditional travel frame works by suspending an artwork from hardware that is attached to the back of the artwork using clips, such as Oz-Clips, brackets, or wires.

For example, the traditional wooden travel frame must be customized to fit the size of the piece of art that is to be stored. Typically, artwork exists in various shapes and sizes which creates a challenge for storing and preparing such pieces of art for travel. Furthermore, travel frames are often disposed of after use with a particular piece of art as they are not often acceptable for use a second time or with a different piece of art. This practice is often wasteful, and expensive.

Existing systems and methods utilize hardware that is bolted directly to the wooden travel frame, and which requires the user to drill holes for the bolts directly into the wood of the travel frame. For long-term storage, a wooden travel frame is often covered with a thin film, or an aluminized nylon barrier film (such as Marvel Seal™) to prevent the natural off-gassing of wood into the closed environment of the travel frame.

When traditional wood storage or travel frames are lined with a moisture or vapor barrier, a pH neutral, archival interior environment is formed when the container is closed, preventing the off-gassing from harming the artwork over time. The film is sometimes activated by a glue to seal it onto the frame. This process is difficult and complicated. The seal could also be punctured, permitting off-gassing to pass and harm to the artwork.

Furthermore, existing systems and methods attempt to address the off-gassing of frame material such as wood, but such methods are often inadequate, difficult and time-consuming to employ. Existing systems and methods utilizing such a film barrier require custom fitting of the film to conform to the interior shape of the wooden frame. This typically requires extensive cutting of the film material and hot pressing the film to the interior surface of the wooden frame, such as by using a hot iron or press, in order for the film to adhere to the all interior surfaces of the frame. As this existing process is difficult and time-consuming, the off-gassing by traditional wooden material is a significant problem that has not yet been adequately solved.

Travel frames are not typically reused because they utilize pre-existing uprights which constrain the storage frame to a particular size of a piece of art, thus making additions or adjustments utilizing the vapor barrier film difficult or unfeasible.

Another problem with the existing methods, is installation of the piece of art. In order to install supporting hardware, several holes must be made into the traditional storage frame by drilling into the wooden frame. During this process, the film or the Marvel Seal™ is pierced, which exposes the wood and allows the off-gassing into the travel frame, and requires additional attention to reseal with additional film. Specifically, in order for the artwork to be supported within the traditional wooden travel frame, several holes must be drilled into the storage frame at positions suitable for supporting hardware systems to support the piece of art. When a hole is drilled to install the hardware to support the piece of art, it must be aligned with a corresponding piece of supporting hardware proximate to the piece of art. Again, this is a problem that has not been adequately addressed and is time consuming and prone to measurement errors. Existing methods of supporting hardware include a bolt, clip, or bracket such as an Oz Clip™, and corresponding supporting hardware within the aluminum travel frame include Agam™ devices for supporting the artwork. The existing method requires screws, which when removed, can create boring of the wood material. The wood frames degrade over time as the art pieces are moved and the screw fasteners must be screwed and unscrewed. Screwing and unscrewing can also result in the stripping of threading. For these reasons also, existing travel frames possess significant problems that have not yet been adequately solved.

In addition, utilizing such film as a solution for off-gassing is inflexible: a piece of art may need to be repositioned within in the traditional wooden frame more than once, and thus drilling and resealing would be needed, and if the travel frame is to be reused for travel or storage of a second piece re-drilling and resealing would also be required.

Furthermore, traditional wood storage or travel frame provide limited options for the material of the lid and back, such as Coroplast or wooden slats.

Accordingly, there is a need for solution to the above identified problems that existing systems and methods have yet to adequately address and to provide a solution that the marketplace has yet to present.

SUMMARY OF THE INVENTION

The instant invention relates to the preservation and storage frame system and method for a container designed to hold flat works of art for long term storage and transportation.

The system is a structural frame constructed of hollow core, non-off-gassing material such as extruded aluminum. Unlike traditional storage or travel frames, the system requires no alteration to or drilling into the body of the frame after its initial construction.

The system requires no treatment for off-gassing, as the material is aluminum, is pH neutral and cannot off-gas. Unlike traditional wood storage or travel frames that only have two options for a lid and back material, Coroplast or wooden slats, three different any numbers of different materials can be used for a lid and back treatment with the system, honeycomb aluminum panel, Dibond, or Coroplast, or any number of other suitable archival W inch thick panel. Accordingly, the instant invention solves one of the traditional problems because it requires no treatment for off-gassing, as the aluminum material itself can be provided as pH neutral and does not typically off-gas.

The preservation and storage frame system holds the artwork by means of a system designed to work with existing, widely used and industry accepted hardware for holding works of art in traditional wooden travel or storage frames. The system allows for multiple universally located art attachment points. Unlike traditional wood storage or travel frames, which require drilling into the wood to install hardware, the system has preinstalled hardware that can be adjusted in position an unlimited number of times. The user can tighten pre-installed hardware with the aid of a hex key.

The method allows the user to install artwork into the frame by moving the adjustable track left or right to align with the hardware/Oz Clip™ on the back of the work, tighten the set screws to lock it in place, move the connector point up and down to align with the hardware/Oz Clip™, and bolt the hardware/Oz Clip™ into the connector point. There is no drilling, no dust, and the method requires less handling of the artwork compared to installing an artwork into a wooden storage frame, and thus avoids human error. The frame can be adjusted an almost unlimited number of times to accommodate a variety of sizes of artworks.

Accordingly, the instant invention solves another problem with traditional systems. While with existing storage or travel frames, it is necessary to drill holes or attach hanging systems for the art using screws, in a preservation and storage frame system according to the invention, the hardware and/or hanging systems are pre-installed, which significantly reduces and/or eliminates any need to alter the frame to install the artwork. Specifically, with traditional storage or travel frames, repositioning the hardware requires that new holes be drilled into the wooden body. This can puncture any treatment, like Marvel Seal™, that has been applied, and over time, these holes can weaken or compromise the strength of the wooden travel or storage frame. This could lead to harm of the artwork. Drilling is difficult, time-consuming, and causes dust which can lead to harm of the artwork. The system solves this problem with the pre-installed hardware which the user can simply tighten with the aid of a hex key. The system preferably only requires hand tools.

The pre-installed hardware can be adjusted in position almost an unlimited number of times. This reduces or eliminates the possibility of harm to the artwork during the alteration of the frame. It also adds the option for the user to adjust the position of the frame as many times as needed without harm to the artwork and with less difficulty.

The system and device of an inter-locking frame wall, and frame storage system according to the invention as described herein is a significant improvement over the state-of-the-art, and applicants submit that the design is new and not obvious at least as of the time of the invention thereof.

Applicants submit that there has been a long felt but unsolved need in the marketplace for an improved storage and travel frame for priceless works of art. Applicants know of no storage or travel frame according to the invention that has been built, used or sold by anyone else. Applicants submit that there has need a long-felt, and yet unmet need in the market for such a device in accordance with the invention.

The need in the market has been expressed presently by museums and art collectors. Applicants submit that there has been a call for new, archival long-term storage solutions in the museum and fine art industry for at least the last 20 years. Many museums have prohibitions on storing art in crates with foam, or un-lined wood (i.e. wood not lined with a vapor barrier like Marvel Seal™). These prohibitions are generally recorded in the museums packing/storage/crating guidelines. One collector of fine arts, the Leiden Collection, will not store any artwork in a box or TF, and another, the Museum of Modern Art, will not store any artwork long term in a foamed wooden crate. These are but two examples of many.

Applicants further submit that others have failed to make significant improvements to solve the problems faced by the industry to improve storage and travel frames for priceless works of art. Half measures, and workarounds, and ad-hoc methods have been expensive, wasteful, time-consuming and ineffective for safeguarding priceless works of art. For example, the current industry practice of lining the interior of a wood travel frame with a thin film, or an aluminized nylon barrier film (such as Marvel Seal™) to prevent the natural off-gassing of wood is expensive, wasteful, time-consuming and ineffective by comparison to a system according to the instant invention.

Applicants submit that the effectiveness of applicants' solution has greatly exceeded expectations, in terms of the reusability of the travel frame, the safety of the work of art when installing the work of art into the travel frame, the safety of the work of art when stored in the travel frame for a period of time, as well as the cost, efficiency and environmental impact of using a travel frame according to the invention.

Applicants further submit that the system and device according to the invention has earned significant commercial success at least as a consequence of the unexpected results. The long felt and yet unmet need in the marketplace for a significant improvement for a storage and travel frame has been met by the system and travel frame and storage device according to the invention, and has piqued great interest.

For example, applicants submit that applicants have received several immediate requests for a travel and storage system for works of art according to the invention from both the Metropolitan Museum of Art, and the Museum of modern Art in New York, N.Y.—which are two industry bellwethers.

Initial test data of non-off gassing materials, such as extruded aluminum, in comparison to wood frames made of poplar or pine, indicate that a storage frame according to the invention will provide significant improvements over the prior art over long periods of time. It may take 20 years for data to be available to see the efficacy of a storage frame according to the invention and actual use.

In addition, initial testing indicates a travel and storage system according to the invention will afford greater safety of a stored artwork. Among other things, testing of a device according to the instant invention indicates that less handling is needed and simpler installation of the artwork is readily accomplished. In addition, testing shows that a device according to the instant invention reduces opportunity for human error and handling and installation, and initial testing indicates that a device according to the instant invention provides greater safety of the artwork when in transit as well as storage.

Accordingly, as described above, a preservation and storage frame system according to the invention of this application provides benefits over the existing travel frames, and solves several of the existing travel frames problems. Among other things, a system according to the invention requires only nuts and bolts, not screws. The current invention provides three options for the lid a back material: honeycomb aluminum panel, Dibond, or Coroplast, whereas existing travel frame designs cannot use such materials readily. Whereas traditional wood storage or travel frames are often destroyed, damaged, or discarded after use, the system can be reused. A system according to the invention of this application can also fabricated from recyclable material, causing less of an environmental impact. The current invention also has the benefit of making it safer for the artwork when custom agents inspect it during transit, as less handling is required to install and de-install the artwork into the frame.

It is to be understood that both the foregoing description and the following description are exemplary and explanatory only and are not restrictive of the invention, as claimed. Specific examples are included in the following description for purposes of clarity, but various details can be changed within the scope of the present invention.

BRIEF DESCRIPTION OF THE DRAWINGS

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE INVENTION

Figure 1:
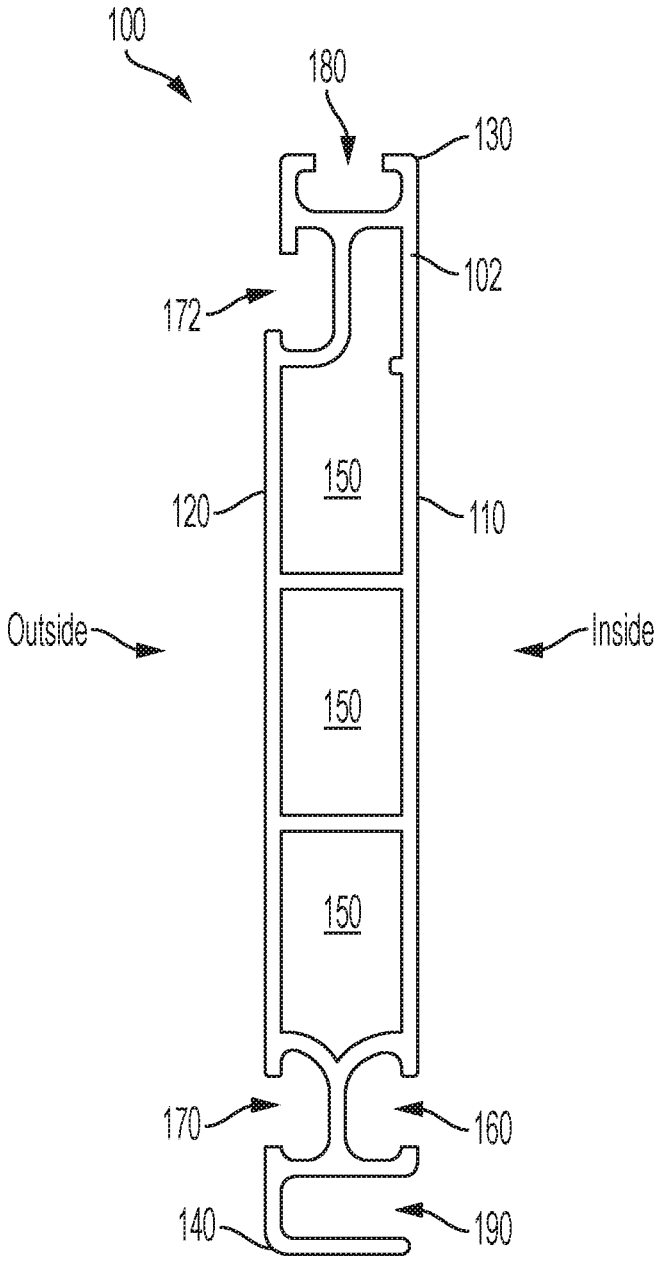
FIG. 1 is a cross section view of an embodiment of the invention and depicting an example of an interlocking frame wall section according to the invention.

Referring to the drawing, FIG. 1 illustrates a preferred embodiment of system and method according to the invention, as well as a best mode is disclosed herein. Specifically, a preservation and storage frame system 100 according to one embodiment of the invention includes at least one interlocking frame wall section 110. The interlocking frame wall section is formed from extruded non-off-gassing material 102, such as aluminum.

The interlocking frame wall section has a number of wall portions that can be fabricated from the extrusion process in a manner to include an interior wall portion 110, an exterior wall portion 120, a front edge portion 130 and a rear edge portion 140. It can be appreciated by those of ordinary skill in the art that the shape of the walls can be conformed to several other interlocking frame wall sections to provide interlocking walls and/or containers.

The interlocking frame wall section can be formed through an extrusion process to include least one interior cavity section 150. It can be appreciated by person of ordinary skill in the art that the cavity sections can be formed by the extrusion process in a manner to give structural integrity to the mechanical functions of the interlocking frame wall section. For example the plurality of wall portions can be formed to surround one or more interior cavity sections.

The preservation and storage frame system can also be provided with a number of channels—for each interlocking frame wall section—disposed on the interior walls in order to provide for a movable attachment mechanism. Preferably, an interior wall portion includes its first interior channel 160 near a bottom portion of the interior wall portion.

Similarly, the exterior wall portion includes its first exterior channel 170 near a bottom portion of the interior wall portion, and a second exterior channel 172 disposed at a top portion of the exterior wall portion.

The preservation and storage frame system can also be provided with a stacking channel 180 for stacking one or more additional interlocking frame wall sections. Specifically, a stacking channel can be provided at a front edge portion of the interlocking frame wall section at its front face.

In addition, in one embodiment of the invention, a rear edge portion of the interlocking frame wall section can include a back panel slot 190 in order to accommodate a back panel 205 to form the back of the storage frame system.

The cavities of the interlocking frame wall section can also be adapted to receive a corner connector 195 or a straight connector for the combination of several interlocking frame wall sections into a desired shape for its intended purpose.

Figure 2:
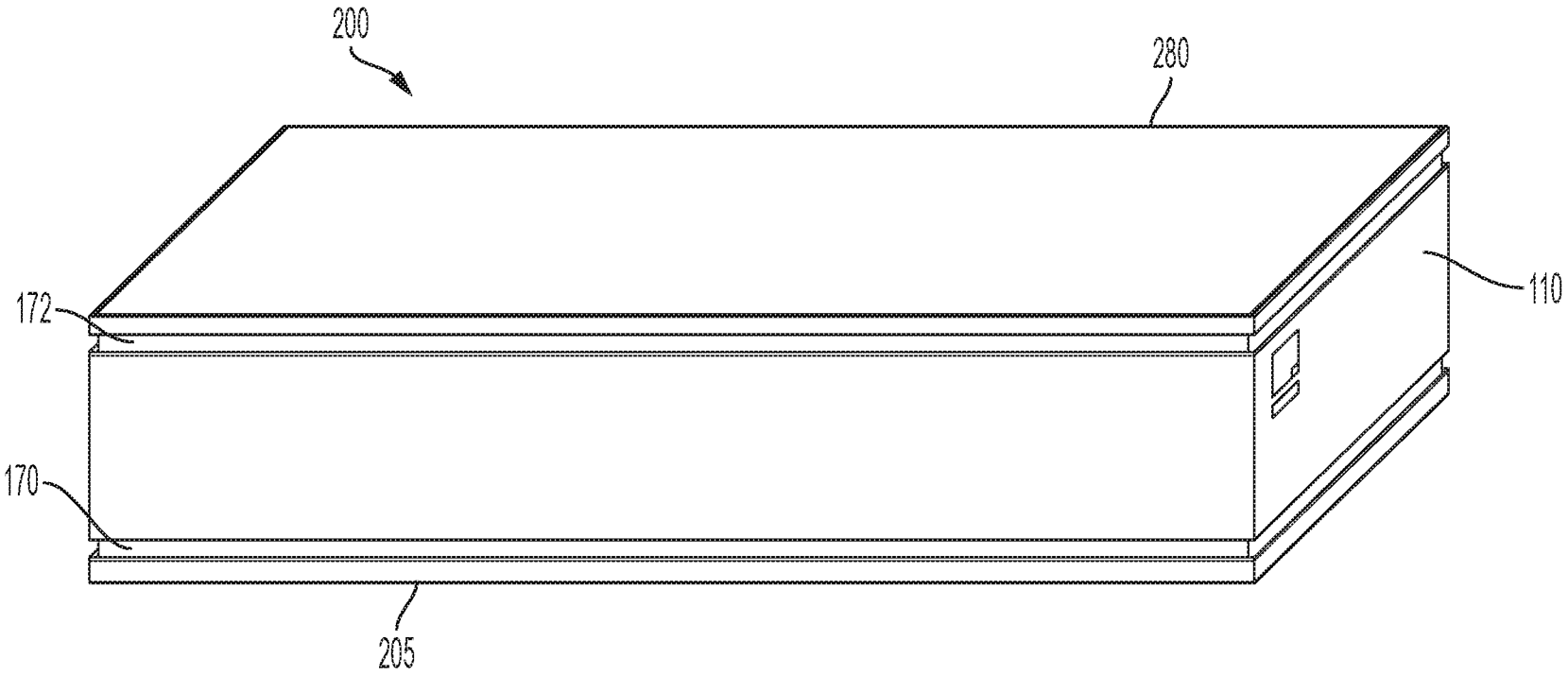
FIG. 2 is a perspective view of a further embodiment of the invention and depicting an example of a preservation and storage frame system unit including interlocking frame wall sections such as shown in FIG. 1.
Figure 2A:
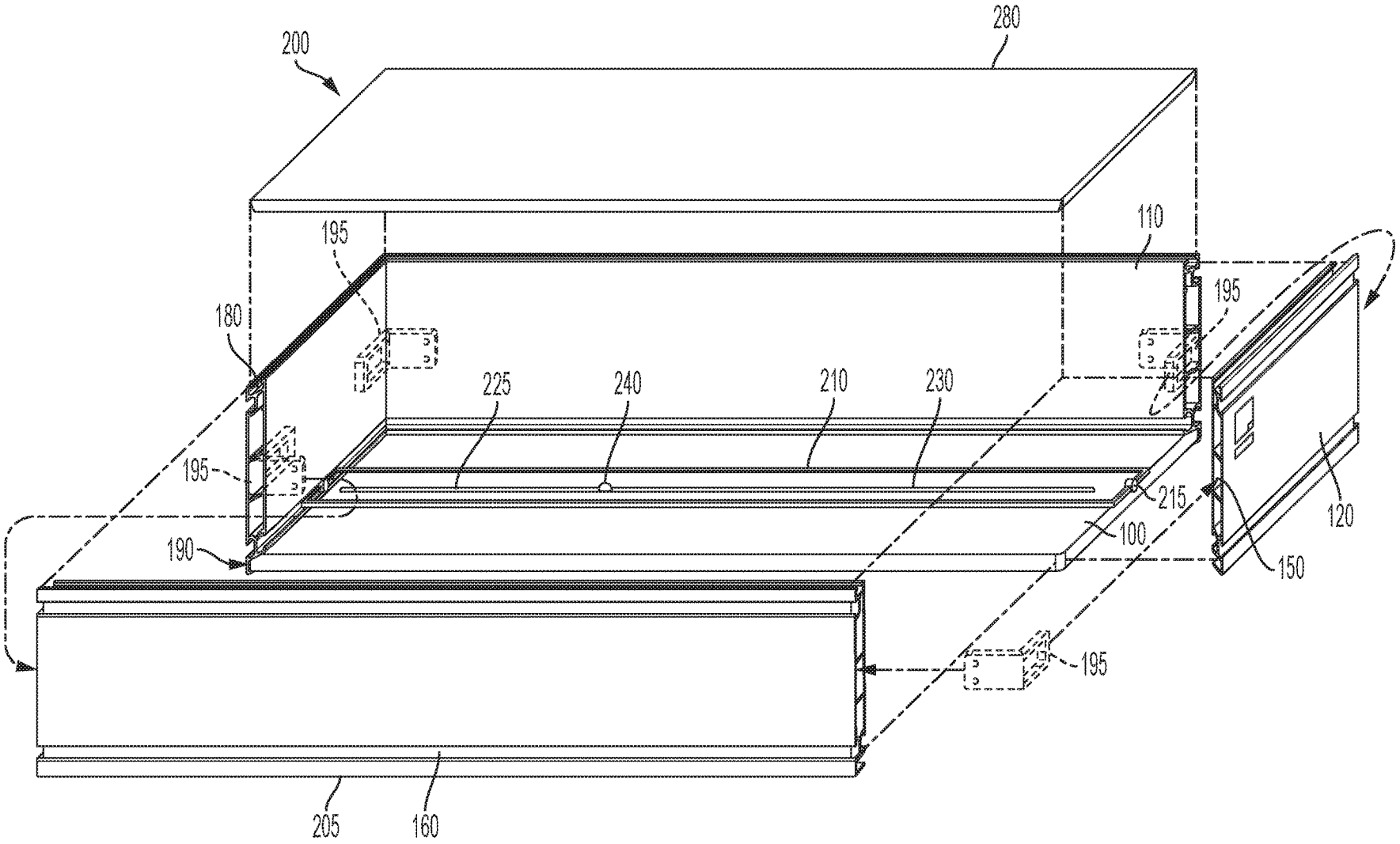
FIG. 2*a* is a perspective view of a further embodiment of the invention and depicting an example of a preservation and storage frame system unit including interlocking frame wall sections such as shown in FIG. 1
Figure 2B:
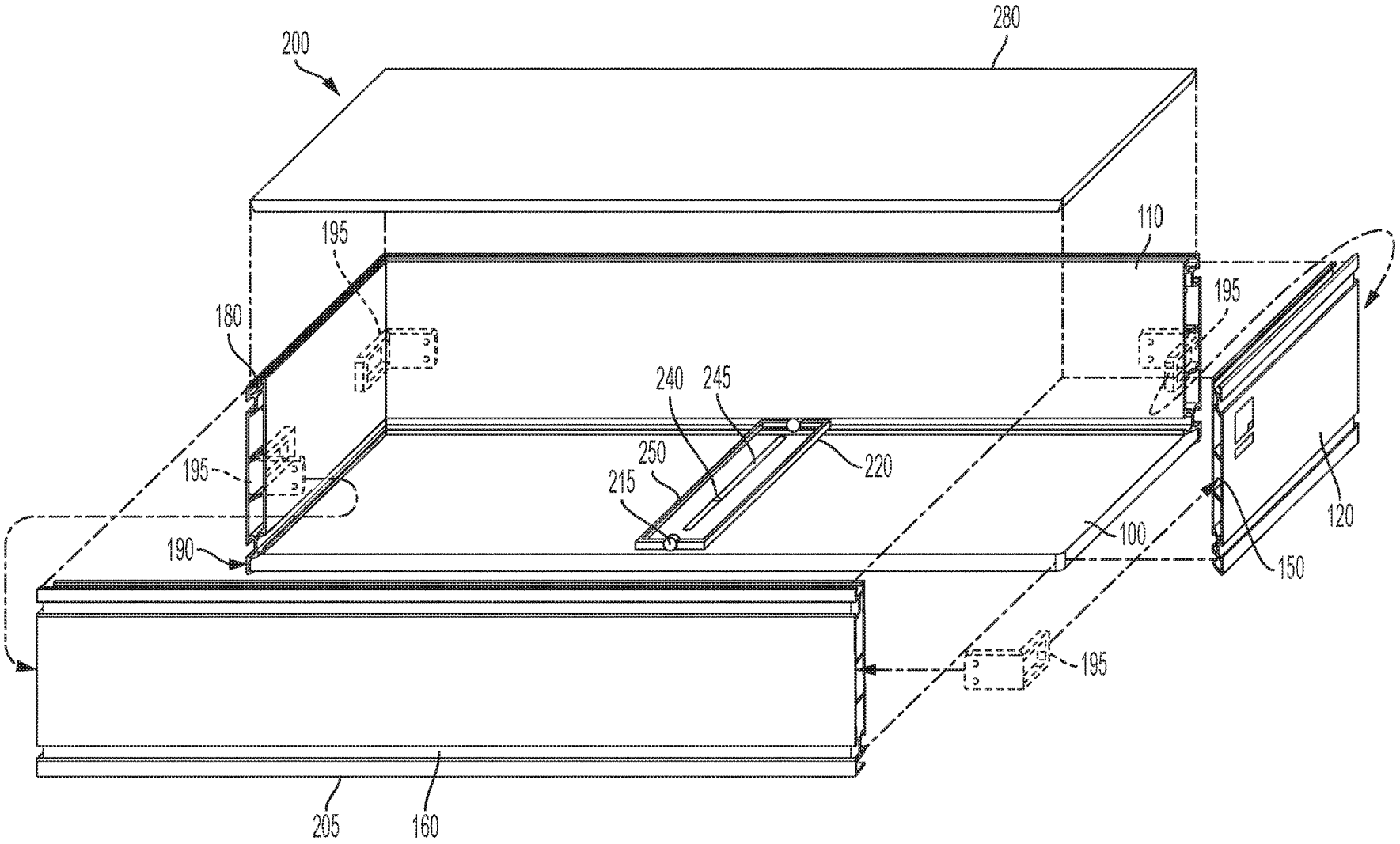
FIG. 2*b* is a perspective view of a further embodiment of the invention and depicting an example of a preservation and storage frame system unit including interlocking frame wall sections such as shown in FIG. 1.
Figure 3B:
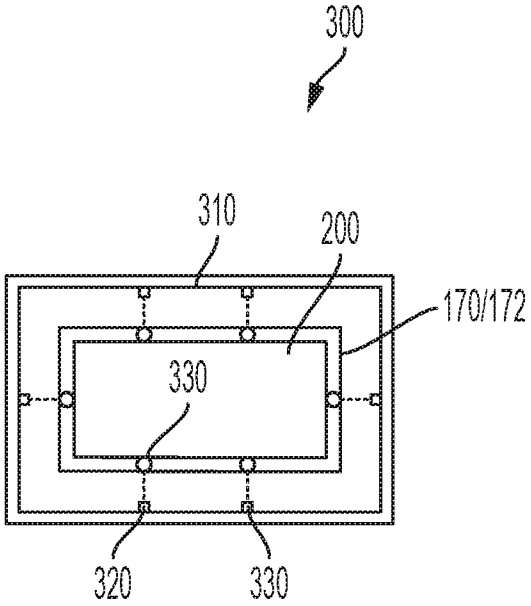
FIG. 3*b* is a cross-sectional view of a further embodiment of the invention depicting an example of an enhanced preservation and storage frame system including a preservation and storage frame system unit according to the invention.
Figure 3A:
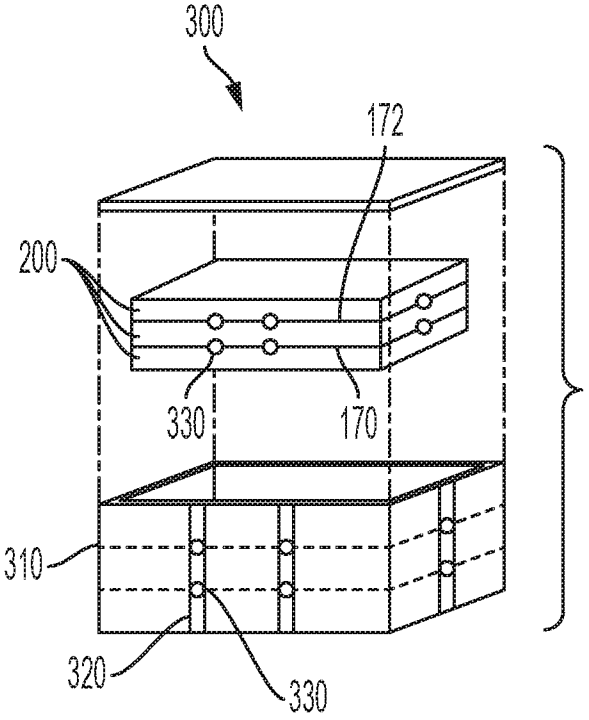
FIG. 3*a* is a perspective view of a further embodiment of the invention depicting an example of an enhanced preservation and storage frame system including a preservation and storage frame system unit according to the invention.

One of the benefits of the interlocking frame wall is that it allows for a modular system such as a preservation and storage frame system unit 200 as shown in FIG. 2, that can be readily adapted, reused and modified to accommodate art work of varying sizes and shapes. Moreover, as shown in FIG. 3, interlocking frame wall section also permits stacking of multiple preservation and storage frame system units 200, as well as an enhanced preservation and storage frame system 300 utilizing an exterior container.

As shown in FIG. 2, in one embodiment the invention, a preservation and storage frame system includes several interlocking frame wall sections 110 such as shown in FIG. 1 as well as a back panel 205, and a front lid 280.

More specifically, the preservation and storage frame system is provided with a number of mechanical support structures for supporting the artwork therein. Accordingly, the system includes at least one movable horizontal slat 210 having a connector portion 215 at an end of the slat so that the slat can move along one of the channels. In one embodiment, the movable horizontal slat can be moved horizontally along the interior channel 160.

Similarly, the system includes movable vertical slats 220, having a connector portion at an end of the slat so that the slat can move along one of the channels. In one embodiment, the movable vertical slat can be moved horizontally along the interior channel 160.

Moreover, in another embodiment, the movable horizontal slat includes its own slat channel 225 along its length at facing the interior of the system typically towards the artwork. This slat channel includes a movable anchor 240 in the slat channel which can move along its length. Similarly, the movable vertical slat includes its own slat channel 245 along its length at facing the interior of the system typically towards the artwork. This slat channel also includes a movable anchor 240 in its slat channel which can move along its length.

Furthermore, movable anchors 240 can be provided which accommodate common industry hardware artwork connectors 270 attached to the artwork such as Oz Clipst™ and T-brackets.

As shown in FIG. 3, in one embodiment the invention, a preservation and storage frame system includes at least one embodiment of a preservation and storage frame unit 200 as shown in FIG. 2 and/or several embodiments of interlocking frame wall sections 110 such as shown in FIG. 1, among other things.

Specifically, one embodiment of a travel and storage frame system according to the invention includes an exterior container 310 adapted to contain an embodiment of a preservation and storage frame unit, such as may be for shipment for stacking a number of preservation and storage frame systems 200 for travel together such as in a container unit.

The exterior container a number of attachment rails 320 on the inside of the container which have movable attachment points 330, which are movable and guided along the rails. These movable connectors can be provided for a fixed connection to an intermediate connector or directly to one of the exterior channels of an interlocking frame wall section.

In a further embodiment, intermediate connectors are provided. The intermediate connectors include adjusters and moveable connectors or brackets 340, to allow adjustment for various sized storage frame systems 100.

The attachment rails also provide opportunity for a range of options, including attaching feet to larger frames for stability in case leaning the frame is not an available option. The rails can also be used for attaching handles. Alternatively, they can be used for attaching cleats that may need to stay with the artwork but are not desired inside the aluminum frame. They can be used to attach hanging hardware for hanging the framed artwork on storage racks. Many institutions use expanded metal storage racks for long term storage, and this aspect of the invention fulfills yet another unmet demand.

Figure 4:
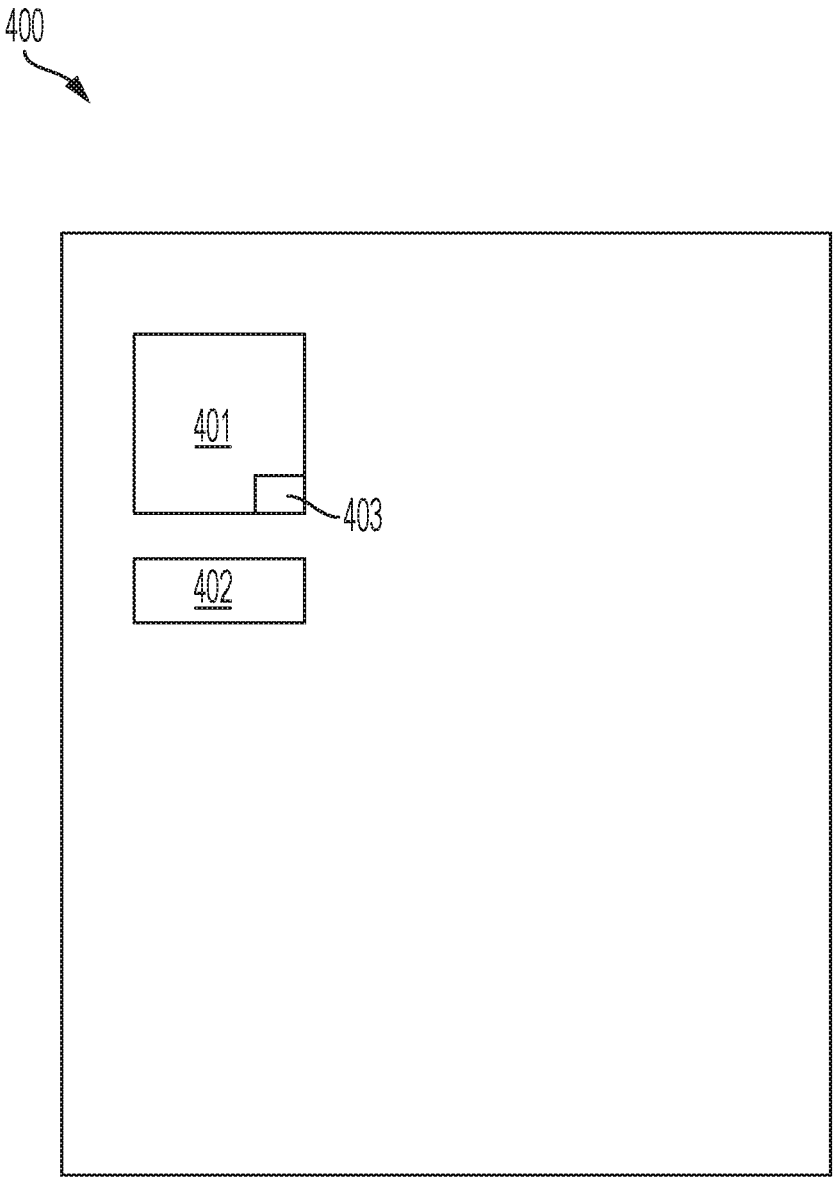
FIG. 4 is a top view of a further embodiment of a front lid for the enhanced preservation and storage frame system according to the invention shown in FIGS. 1-3.

As shown in FIG. 4, in a further embodiment the invention, includes a front lid 400 having a window 401, and an identification and data system 402. The window 401 is transparent, and disposed in an aperture of the front lid whereby visual inspection and/or verification of any contents of the preservation and storage frame system 200 can be made. The identification and data system 402, includes one or more sensors for detecting environmental conditions within a preservation and storage frame system 200 according to the invention. The sensors can include sensors for temperature, humidity, as well as gases which may be found either in a typical atmospheric environment or which may be expected from off-gassing of certain materials, such the stored artwork. It can be appreciated by those of ordinary skill in the art familiar with Oddy testing, that the window 401 can be used in conjunction with other sensors, such as non-off-gassing metal compound 403 disposed on an inside portion of the lid, and proximate to the window such as to be viewable through the window. Thereby, the deposition of any volatile compounds within the storage system can be measured over a longer period of time by their effect on the metal coupons.

In a further embodiment of the invention, the identification and data system 402 includes a display, input device, and a data storage unit whereby identification information related to the storage system 200 can be provided, stored and displayed. Among other things, identification information includes a unique identifier for the storage system 200, stored artwork information, such as a name of the artwork, owner of the artwork, delivery information, such as time and date of delivery, as well as storage information, such as time and date of the sealing of the artwork within the storage system 200, as well as initial environmental conditions at the time the storage system 200 is sealed.

Various changes may be made to the system and process embodying the principles of the invention. The foregoing embodiments are set forth in an illustrative and not in a limiting sense. The scope of the invention is defined by the claims appended hereto.

The invention claimed is:

1. A preservation and storage frame system for preserving valuable artwork, comprising:

at least one interlocking frame wall section, wherein said interlocking frame wall section is formed from extruded non-off gassing aluminum wherein said interlocking frame wall section has a plurality of wall portions, said plurality of wall portions including an interior wall portion, an exterior wall portion, a stacking edge portion, a panel edge portion; and said interlocking frame wall section further comprising at least one interior cavity section surrounded by said plurality of wall portions at at least four sides of said at least one interior cavity section;

wherein said interior wall portion includes a first interior charnel, wherein said exterior wall portion includes a first exterior channel, and a second exterior channel, wherein said stacking edge portion includes a stacking channel disposed at an edge face of said stacking edge portion, wherein said panel edge portion includes a panel slot, wherein said at least one cavity section is adapted to receive a corner connector, and a lid comprising a non-off-gassing material.

2. A preservation and storage frame system according to claim 1 wherein said lid includes a window.

3. A preservation and storage frame system according to claim 2 wherein said lid includes an identification and data system.

4. A preservation and storage frame system according to claim 3 wherein said identification and data system includes a display, an input device, and a data storage unit having a processor adapted to receive, store and display identification information related to a piece of artwork.

5. A preservation and storage frame system according to claim 2 wherein said lid includes at least one non-off-gassing metal compound disposed on an inside portion of the lid, and proximate to the window such as to be viewable through the window.

6. A preservation and storage frame device for preserving valuable artwork, comprising:

at least one interlocking frame wall section, wherein said interlocking frame wall section is formed from extruded non-off gassing aluminum;

wherein said interlocking frame wall section includes a stacking edge portion, a panel edge portion; at least one interior cavity section; a first interior channel disposed at an interior side of the frame wall section, a first exterior channel disposed at an exterior side of the frame wall section, a second exterior channel disposed proximate to said stacking edge portion on said exterior side, and a stacking channel disposed at said stacking edge portion, wherein said panel edge portion includes a panel slot being adapted to receive a panel disposed on a plane orthogonal to the interior wall portion, and wherein said at least one cavity section is adapted to receive a corner connector, and a lid comprising a non-off-gassing material.

7. A preservation and storage frame device according to claim 6 further comprising a panel connected to said at least one interlocking frame wall section, and at least one corner connector connected to said at least one interlocking frame wall section, thereby forming a frame.

8. A preservation and storage frame device according to claim 6 further comprising at least one first movable slat, wherein said first movable slat includes a connector portion disposed at an end of said first movable slat and adapted for being movably connected to said first interior channel, whereby said first movable slat can be moved along said interior channel.

9. A preservation and storage frame device according to claim 8 wherein said first movable slat further includes a slat channel disposed lengthwise along said first movable slat at an interior face thereof, and said slat channel includes a movable anchor disposed within said slat channel, whereby said movable anchor is movable lengthwise along said slat channel.

10. A preservation and storage frame device according to claim 9, wherein said movable anchor includes an artwork connector selected from the group comprising an Oz clip and a T bracket.

11. A preservation and storage frame device according to claim 8 further comprising at least one second movable slat, wherein said second movable slat includes a connector portion disposed at an end of said movable slat and adapted for being movably connected to said first interior channel of a second interlocking frame wall section, wherein said second slat is orthogonal to said first slat and whereby said second movable slat can be moved along said interior channel.

12. A preservation and storage frame device according to claim 11 wherein said second movable slat further includes a slat channel disposed lengthwise along said second movable slat at an interior face thereof, and said slat channel includes a movable anchor disposed within said slat channel, whereby said movable anchor is movable lengthwise along said slat channel.

13. A preservation and storage frame device according to claim 12, wherein said movable anchor includes an artwork connector selected from the group comprising an Oz clip and a T bracket.

14. A preservation and storage frame system according to claim 6 including said lid having a window.

15. A preservation and storage frame device according to claim 14 wherein said a lid includes an identification and data system.

16. A preservation and storage frame device according to claim 15 wherein said identification and data system includes a display, an input device, and a data storage unit having a processor adapted to receive, store and display identification information related to a piece of artwork.

17. A preservation and storage frame device according to claim 14 wherein said lid includes at least one non-off-gassing metal compound disposed on an inside portion of the lid, and proximate to the window such as to be viewable through the window.

* * * * *